United States Patent [19]

Schwartz

[11] 4,158,157

[45] Jun. 12, 1979

[54] ELECTRON BEAM CATHODOLUMINESCENT PANEL DISPLAY

[75] Inventor: James W. Schwartz, Deerfield, Ill.

[73] Assignee: Zenith Radio Corporation, Glenview, Ill.

[21] Appl. No.: 735,465

[22] Filed: Oct. 26, 1976

[51] Int. Cl.[2] ..... H01J 29/70; H01J 29/72

[52] U.S. Cl. ..... 315/366; 313/422

[58] Field of Search ..... 315/13 R, 366; 313/422, 313/427

[56] References Cited

U.S. PATENT DOCUMENTS

| | | | |
|---|---|---|---|
| 2,863,091 | 12/1958 | Epstein et al. | 313/422 |
| 2,904,722 | 9/1959 | Aiken | 313/422 |
| 2,961,575 | 11/1960 | Pohl | 313/422 |
| 3,723,786 | 3/1973 | Charles | 313/422 |
| 4,028,582 | 6/1977 | Anderson et al. | 313/422 |
| 4,088,920 | 5/1978 | Siekanowicz et al. | 315/366 |

FOREIGN PATENT DOCUMENTS 2638308 3/1977 Fed. Rep. of Germany.

*Primary Examiner*—Theodore M. Blum
*Attorney, Agent, or Firm*—Ralph E. Clarke, Jr.

[57] ABSTRACT

This disclosure depicts an image display panel partitioned into two distinct sections comprising a high voltage front section and a low voltage rear section. An electron source means located in the low-voltage rear section is disposed along a row-wise edge of the panel for generating a supply of electrons. A plurality of low-energy electron beams drawn from the electron source means are formed, shaped and modulated. Each beam is directed into a beam guide-isolator responsive to relatively low applied beam control voltages. The beams are further directed by the plurality of beam guide-isolators perpendicular to said edge and parallel to the image display panel faceplate, and are repetitively, and preferably substantially periodically, focused and refocused to constrain the electrons from leaving the beam guide-isolators. Beam diverting means responsive to the application of relatively low applied beam diverting voltages sharply divert the beams through apertures in the beam guide-isolators from selected precise positions opposite the faceplate. The electrons of each beam are accelerated to a high energy in the high voltage front section to activate cathodoluminescent phosphor targets.

9 Claims, 16 Drawing Figures

ELECTRON BEAM CATHODOLUMINESCENT PANEL DISPLAY

BACKGROUND OF THE INVENTION

This invention concerns an electron beam cathodoluminescent panel display suitable for the display of television pictures. It is also useful for other image displays such as alphanumeric, computer and computer graphics.

The achievement of a feasible and practical flat panel television display has long been a goal of technologists in many parts of the world. However, to have widespread commercial significance, any such display must be technically and economically competitive with conventional cathode-ray picture tubes.

Such picture tubes are in an advanced state of refinement. In many respects, the attainable picture performance of the picture tube is at such a high level that there is little practical incentive for further technological improvements. Contrast ratios, brightness levels, raster linearity, interlace and color field registration are quite acceptable to television viewers. Resolution, particularly in picture highlight areas, however, generally falls discernibly below theoretical system limits. This impediment is being overcome by new types of high-resolution electron guns coming into use.

Conventional picture tubes do have characteristics that provide incentive to create a commercially viable alternative such as the flat panel display. For example, the picture tube has a very real, practical size limitation. The largest color tubes commonly in current production have a display screen with an approximately 25-inch diagonal measurement, providing about 315 square inches of viewing area. The 25-inch measurement does not represent an absolute physical limit, but there are a number of practical considerations which rule out any major increase. Volume, weight and cost of the picture tube envelope tend to increase very rapidly for even modest increases in picture area. In addition, equivalent brightness and resolution are difficult if not impossible to attain in larger configurations.

In view of these disadvantages, the flat panel display represents a highly attractive alternative. An ideal panel display would provide picture performance equal to or exceeding the present quality levels of the picture tube, and would not be so rigorously size-limited.

A major effort in creating a flat panel display has been directed to the gas-discharge type; however, panels developed to date have not demonstrated adequate efficiency. In view of this fact, the efficiency of the electron beam of the picture tube in activating cathodoluminescence makes the use of such beams highly attractive in a panel display. Also, there is a wealth of readily available picture tube technology that is applicable to a panel display using electron beams; phosphor and high-vacuum technologies are prime examples.

An attempt to utilize the electron beam in a flat panel display is shown by the "Aiken" tube (refer to FIG. 1) wherein a pair of electron guns 10 project beams 12 parallel to two enveloping plates 14 and 16, one of which is transparent. Beams 12 are diverted to fall upon opposite sides of cathodoluminescent surface 18. The beams are diverted by deflection plates 20 and 22, which are used to scan surface 18 in vertical and horizontal directions to produce an image. The concept is covered in a series of U.S. patents by Aiken, including U.S. Pat. No. 3,313,970. The beams are of high energy, and high potentials on the deflection plates are required to divert the beams toward the cathodoluminescent surface, making the tube impractical for consumer product television displays. Color rendition has also been less than ideal. Further, since the envelope is not self-supporting against atmospheric pressure, the concept would seem to be adaptable to only relatively small displays.

Gabor has disclosed a three-beam flat panel color display tube shown in highly simplified schematic form in FIG. 2. Three electron beams 24 are generated by electron guns 26, and turned back one hundred and eighty degrees around barrier 28 into an adjacent beam channel 30, where the beams are diverted again ninety degrees by electrodes 32 to impinge upon and scan cathodoluminescent color phosphor screen 34 through a shadow mask 36. This concept is covered in U.S. Pat. No. 3,171,056, among others. The Gabor tube is a very complex structure which must be made with extreme precision. Beam energies are relatively high, and high deflection potentials are required to scan the beam. It is believed that a complete operative tube has never been made. It is also thought that such a tube, if realizable, would be seriously effected by external influences such as the earth's magnetic field. Like the Aiken tube, it is not a self-supporting structure so its use would also be restricted to relatively small displays.

Charles, in U.S. Pat. No. 3,723,786, discloses a flat cathode-ray tube for direct viewing spot display of letters and numbers, as shown in simplified perspective form in FIG. 3. A longitudinal heater strip 38 comprising a series of thermionic emitters generates electrons which are formed into a series of electron beams 40 modulated by a succession of grids 42. The beams enter a space between two facing plates, one a backplate 44 having a series of horizontal strip electrodes 46 thereon, and the opposite plate a glass faceplate 48 having a conductive layer 50 and a cathodoluminescent material deposited thereon. The potentials on the strip electrodes 46 and the conductive layer 50 are made equal, resulting in "practically an equipotential space" (quoted from column 3, lines 23–24 of the subject patent). The beams travel through the space 52 to a collector electrode 54. Reducing the voltage on a conductive strip causes the potential to become unequal and results in diversion of the beams toward the faceplate at the level of the strip, according to the disclosure. The device as shown would seem to lend itself to only the simplest of displays. Again, such a display would necessarily be small as the structure is not self-supporting.

In summing up, it appears that attempts to apply electron-beam picture tube technology to a flat panel display have been largely frustrated by one or both of such factors as the screen-size limitation dictated by the difficulty of providing internal envelope support in regions of beam excursion, and the need to utilize a high-energy beam to get adequate phosphor excitation. This need in turn dictates that beam control and modulating voltages be correspondingly high and out of the practical realm of utilization of transistor and integrated circuit technology.

Other Prior Art

| | | | |
|---|---|---|---|
| 2,795,731 | Aiken | 3,177,395 | Namordi et al |
| 2,967,965 | Schwartz | 3,181,027 | Geer |
| 2,858,464 | Roberts | 3,379,912 | Shanafelt |
| 2,879,446 | Aiken | 3,435,269 | Shanafelt |

-continued

| Other Prior Art | | | |
|---|---|---|---|
| 2,945,982 | Foster | 3,461,333 | Havn |
| 2,978,601 | Aiken | 3,395,312 | Freestone et al |
| 3,005,127 | Aiken | 3,683,224 | Lea |
| | | 3,904,923 | Schwartz |

OBJECTS OF THE INVENTION

It is a primary object of this invention to provide a practical panel display activated by electron beams.

It is another object of this invention to provide an electron beam panel display whose envelope is self-supporting, and wherein the size of the display area is not limited by factors such as atmospheric pressure.

It is a less general object to provide an electron beam panel display capable of television picture reproduction fully compatible with NTSC standards.

It is an object to provide an electron beam panel display system that can utilize to the fullest the proven technology of the television cathode-ray picture tube system, such as phosphor and high vacuum technology.

It is a specific object to provide an electron beam panel display generating guided low-energy beams that can be propagated, controlled, modulated and diverted by relatively low potentials so as to use to the fullest the present-day technology of transistors and integrated circuits.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings in which;

DESCRIPTION OF THE PREFERRED EMBODIMENTS

For thorough understanding of the present invention, together with other further objects, advantages and capabilities thereof, reference is made to the following specification and claims in connection with the aforedescribed drawings.

Figure 1:
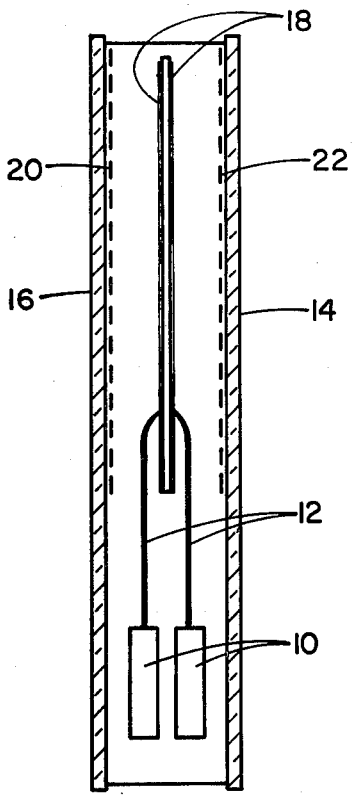
Fig. 1 PRIOR ART
FIGS. 1, 2 and 3 illustrate in highly schematic form prior art flat panel image display devices utilizing electron beams.
Figure 2:
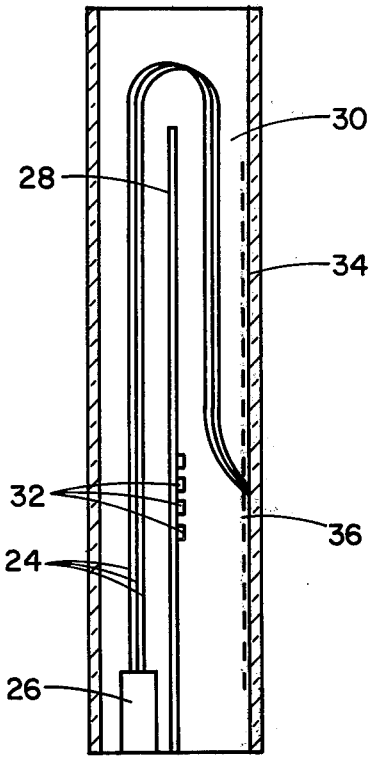
Fig. 2 PRIOR ART
Figure 3:
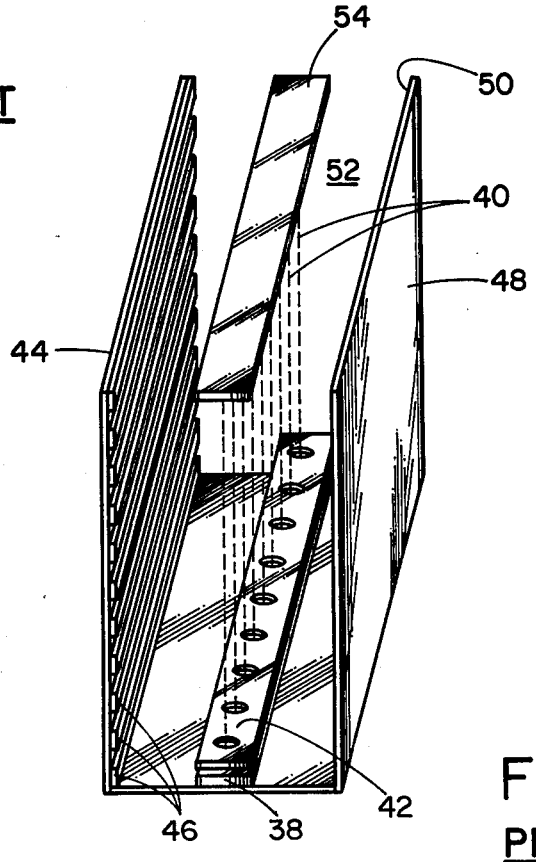
Fig. 3 PRIOR ART
Figure 4:
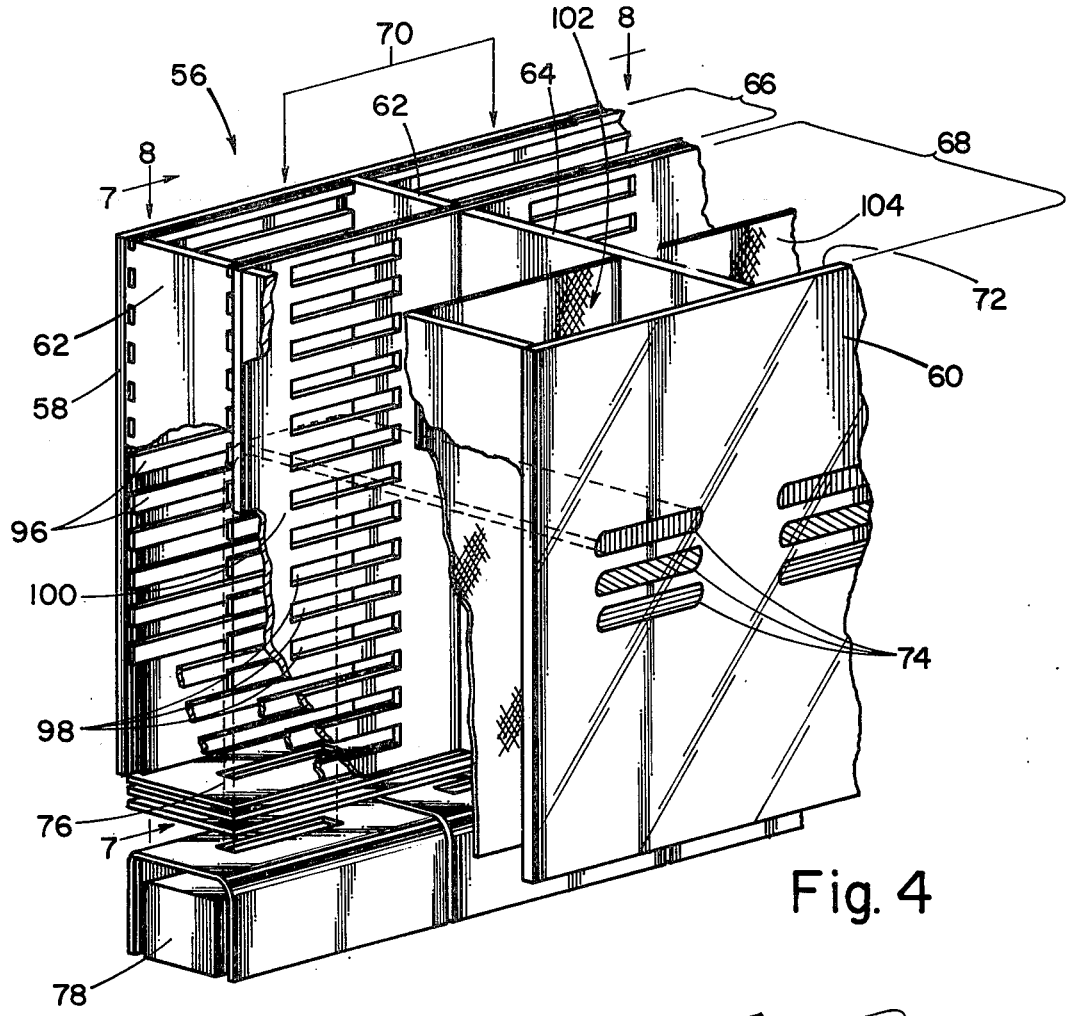
FIG. 4 is a highly schematic fragmentary view in perspective of a cathodoluminescent panel display constructed in accordance with the principles of this invention.

There is shown in FIG. 4 a section of an image display panel 56 having a back wall 58 and a faceplate 60 which comprise the back and front members of a standard flat panel configuration well-known in the art. The complete structure comprises an evacuated, self-supporting envelope, with said support supplied by a succession of back-to-front extending side plates 62, each of which abuts upon a vertically extending spacer 64. The internal, bridging support supplied by side plates 62 and vertically extending spacers 64, which are in close adjacency throughout the panel, makes it possible for panel 56 to support the immense force of the atmosphere upon back wall 58 and faceplate 60. In a panel display having a 50-inch diagonal measure, for example, the force of the atmosphere upon the evacuated envelope approaches eighteen tons; that is, nine tons per side.

Panel 56 is shown as being partitioned into two distinct sections comprising a low-voltage rear section 66 and a high-voltage front section 68. The high-voltage front section 68 preferably comprises a faceplate 60 having an anode 72 which receives a relatively high voltage; that is, a voltage in the range of kilovolts. The low voltage rear section 66 is shown as being located contiguous to back wall 58 and comprises a column-wise succession of beam guide-isolators 70 disposed along the entire width of the panel. The number of such beam guide-isolators 70 may preferably be 500 in a typical panel. According to this invention, however, there may be a greater or lesser number depending upon specific panel configuration requirements.

The progression of an electron beam 76 according to this invention from the electron source 78 to its point of impingement on at least one phosphor target 74 on faceplate 60 will now be described. Electron source 78, which is shown as a monolithic structure disposed along a row-wise edge of panel 56, comprises a source of electrons for all of the electron beams guided by the succession of beam guide-isolators 70. Electron source 78 is shown as being disposed at the bottom edge of the panel; it could as well be at the top edge.

Figure 5:
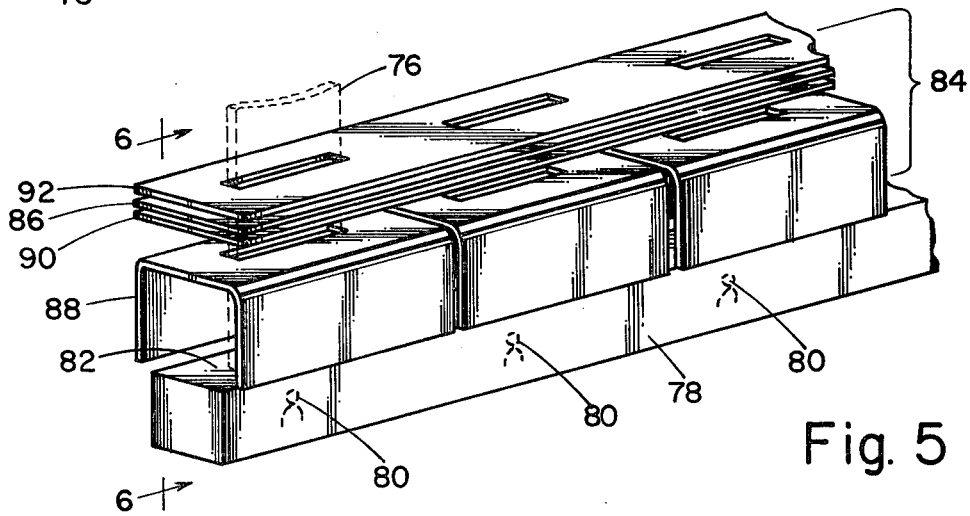
FIG. 5 shows in greater detail in perspective the electron source and grid sections shown by FIG. 4.
Figure 6:
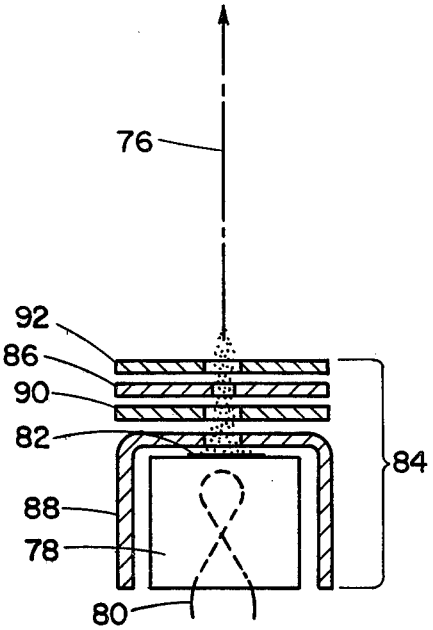
FIG. 6 is a side view in section of the electron source and grid means taken along lines 6—6 of FIG. 5.
Figure 7:
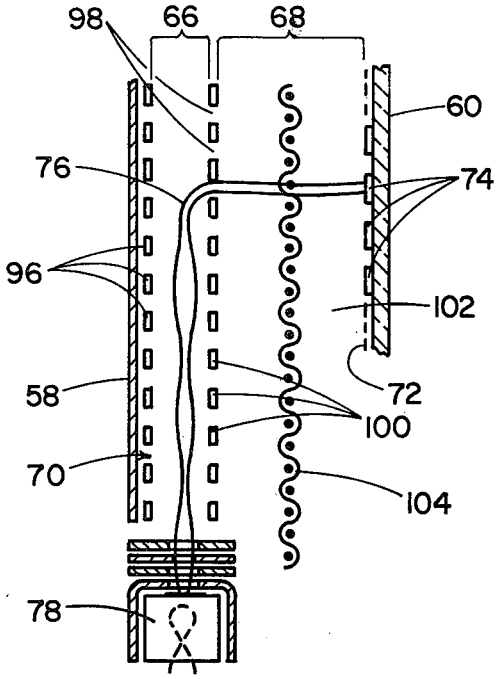
FIG. 7 is a side view in section taken along lines 7—7 of FIG. 4, showing in highly schematic form the guidance and diversion of an electron beam in a beam guide-isolator structure designed to implement the teachings of this invention.

Referring additionally now to FIGS. 5, 6 and 7, electron source 78 may be energized by a single element or a plurality of resistive heater elements 80 therein embedded. The heating of electron source 78 results in turn in the heating of a thermionic material 82 disposed on a top surface of electron source 78, causing the emission of electrons from electron source 78 to form electron beam 76. This material may comprise any of a number of well-known thermionic emission compounds.

Electron beam 76 is then shaped and modulated by a sequential series of grid means 84 interspersed with at least one baffle means 86. The functions of the several grid means 84 and baffle means 86 will be dealt with in greater detail further on in this disclosure; however, a general description is supplied at this point to provide an overall understanding of the operation of the preferred embodiment of this invention as shown and described.

Modulation grid 88 initiates the segregating and collimating of electrons emitted by thermionic material 82 into a substantially rectangular beam form shown by the figures. Because of its contiguity to electron source 78, a time-varying signal applied to modulation grid 88 can be of a relatively low voltage. There is a separate, electrically discrete modulation grid 88 for each beam. Following in succession are unitary row-wise-extending accelerating means comprising at least one grid 90, and row-wise-extending decelerating means comprising at least one grid 92, interspersed with at least one baffle 86. Each of the grids represented schematically by 90 and 92 in FIGS. 5 and 6 may actually comprise of a plural number of grids rather than the single grids shown for initial expository purposes.

Upon emergence from decelerating grids 92, electron beam 76 having been modulated, and formed and shaped as shown, enters beam guide-isolator 70. Beam guide-isolator 70 directs the beam perpendicular to the edge of panel 56 and parallel to faceplate 60, providing a vertically propagated beam. Electron beam 76 is preferably a relatively low-energy electron beam; that is, a beam having an energy in the range of a few tens of electron volts, or potentials may be in the range of a few hundreds of electron volts. During its passage through beam guide-isolator 70, electron beam 76 is preferably subjected to a repetitive succession of higher and lower focusing and refocusing voltages, preferably substantially periodic, to prevent the electrons comprising the beam from leaving or striking beam guide-isolator 70.

In FIGS. 4 and 7, electron beam 76 is shown as being sharply diverted from a selected precise position opposite faceplate 60 by the application of a relatively low applied beam diverting voltage applied to one of a plurality of row-wise extending conductive strips 96. Electron beam 76 emerges from beam guide-isolator 70 through one of a plurality of apertures 98 in a ladder electrode 100, shown in highly schematic form in FIG. 4.

Upon emerging from one of said apertures 98, electron beam 76 enters high-gradient field area 102, whereupon the electrons of electron beam 76 are accelerated to a high energy to activate at least one of a pattern of cathodoluminescent phosphor targets 74 located on an inner surface of faceplate 60. In passage through the high-voltage front section 68 and its high-gradient field area 102, the velocity of the electrons comprising beam 76 are accelerated by the relatively high potential of anode 72. This potential may, for example, be in the range of 800 to 10,000 volts. These values, however, are not limiting. The impact of this high energy beam upon a phosphor target 74 provides a very bright emission from the phosphor target.

Figure 8:
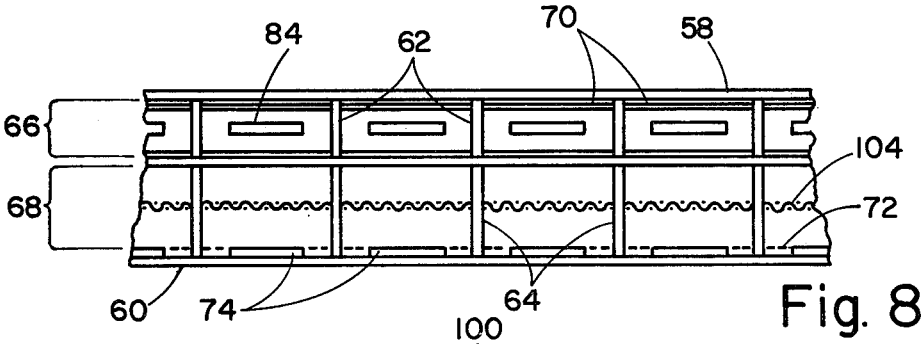
FIG. 8 is an enlarged fragmentary sectional view taken along lines 8—8 of FIG. 4 showing a succession of beam guide-isolators.

FIG. 8 provides a further illustration of the preferred embodiment, showing a top view of the structure. As will be clearly seen again in this view, the panel is partitioned into two distinct sections—a low-voltage rear section 66 and a high-voltage front section 68. This partitioning makes possible the generation of an electron beam having very low energy which can be propagated, controlled, shaped, modulated and diverted by relatively low potentials so as to be able to use to the fullest the present-day technology of transistors and integrated circuits. However, a beam of such low energy is by its nature ineffectual in activating a phosphor target to adequate brightness; hence, the relevance of the second distinct section that represents an aspect of the preferred embodiment of this invention—the high-voltage front section 68. This high voltage front section imparts to the beam the high energy necessary for the bright illumination of the phosphor targets.

Although beam guide-isolator 70 provides for effective containment of the electron beam by means of the aforesaid repetitive and substantially periodic focusing and refocusing, it may be preferable to provide further isolation between the low-voltage rear section 66 and high-voltage front section 68. The propinquity of the beam guide-isolator 70 located in low voltage rear section 66 to high-voltage anode 72 on faceplate 60 constitutes an inducement for the electrons in beam 76 to leave beam guide-isolator 70 and travel through high gradient field area 102 to anode 72. The distance between electron beam 76 and anode 72 may be, for example, less than one-half inch. Any electrons straying from beam 76 and randomly impinging upon phosphor target 74 may produce a diffused glow on faceplate 60, resulting in a reduction of image contrast. In actuality, the structure of the preferred embodiment of the beam guide-isolator 70 as shown, which provides for a repetitive focusing and refocusing of the electron beam, and preferably substantially periodic, markedly inhibits the escape of electrons from electron beam 76.

However, it may be beneficial to install an electron-transmissive screen 104 disposed between the beam guide-isolator 70 and faceplate 60. The purpose of screen 104, which has a nominal potential of, for example, several hundred volts, is two-fold: (1) to present to electron beam 76 a relatively controllable field, one which does not upset the constraining forces on the beam passing through beam guide-isolator 70, and one providing an initial, relatively mild electron acceleration, and (2), to isolate the electron accelerating high gradient field of high-voltage front section 68 from low-voltage rear section 66.

Figure 9A:
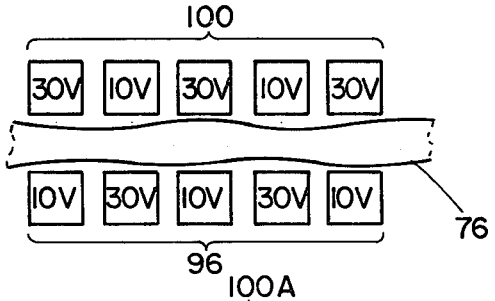
FIGS. 9A and 9B show in highly simplified block form alternate electrode potentials and shapes according to this invention.
Figure 9B:
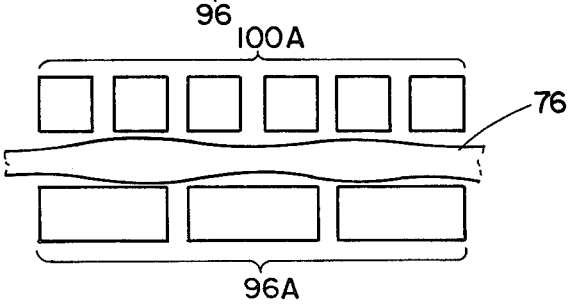
Figure 9:
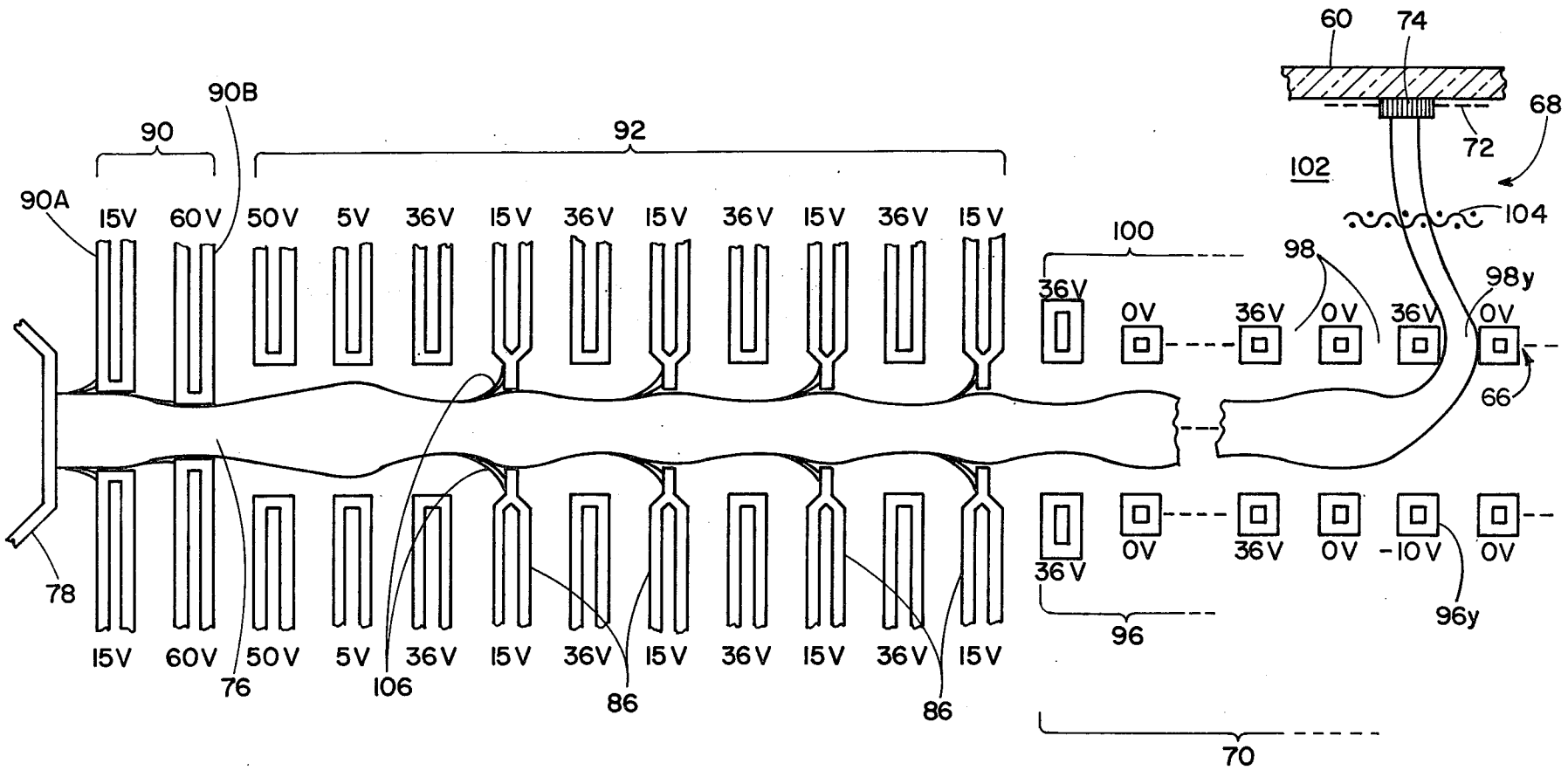
FIG. 9 is a computer plot showing the excursion of an electron beam according to this invention from an electron source to a phosphor target.

FIG. 9 is a computer plot showing the progression of an electron beam 76 from electron source 78 through an accelerating means 90 and decelerating means 92, followed by entry of the beam into beam guide-isolator 70, and the diversion of the beam through one of a plurality of ladder apertures 98 to a point of impingement on phosphor target 74. This structural aspect of the preferred embodiment of this invention fulfills the objective of providing an electron beam having a low-energy level responsive to low beam-directing, modulating, and diverting voltages. However, to achieve the equally important objective of an adequate brightness level of the display, the electron beam must reach its phosphor target with sufficient energy to adequately excite the phosphor to the desired brightness level. These objectives are accomplished by the FIG. 9 structure which represents the preferred embodiment of this invention, as will be shown.

The potentials on each of the succession of grids of accelerating means 90, decelerating means 92 and the individual electrodes comprising ladder electrode 100 are shown in relation to each grid; that is, from left to right, fifteen volts, sixty volts, fifty volts, etc. These values are not necessarily limiting, but may be relatively higher or lower and of different sequence to achieve the objective of an electron beam 76 responsive to relatively low potentials.

It will be noted that accelerating means 90 comprises a first grid 90A, and a second grid 90B which is an accelerating grid having thereon a relatively higher potential of, for example, sixty volts, for drawing from electron source 78 a desired electron density and accelerating the electrons. However, this drawing from, and accelerating of, electrons from electron source 78 also imparts to electron beam 76 an undesired higher energy level inconsonant with the objective of a low-energy beam. So the accelerating means 90 is followed in sequence by a decelerating means 92, comprising at least one decelerating grid. The values noted supra to each of decelerating grids of decelerating means 92 in FIG. 9 represent voltages that initiate the repetitive focusing and refocusing, preferably periodic according to the preferred embodiment, of electron beam 76 that is typical in the travel of the beam in its entire passage through beam guide isolator 70. As is well-known in the art, an electron beam, when subjected to a decelerating potential, tends to expand. One result of this expansion is the undesired emission of aberrant electrons from the main path of the beam as shown by 106. If allowed to travel unintercepted, these aberrant electrons 106 could randomly reach the phosphor targets located at the lower section of faceplate 60 to cause a diffused glow on the faceplate. A series of baffle means 86 having beam-passing apertures smaller than the associated grid apertures may be provided to intercept aberrant electrons 106 in their path outside the main path of electron beam 76.

As a result of its passage through accelerating means 90 and decelerating means 92, electron beam 76 now displays the desired characteristics of being repetitively and substantially periodically focused, devoid of aberrant electrons, and responsive to relatively low beam-control voltages.

electron beam 76 emerges from accelerating and decelerating means 90 and 92 to enter beam guide-isolator 70. As shown by FIG. 9, the opposed pairs of the electrodes comprising ladder electrode 100, and the electrodes comprising the ladder-like conductive strips 96, are shown as having a preferably identical potential thereon so that the different potentials along beam guide isolator 70 preferably impose upon the beam a substantially periodic succession of higher and lower focusing and refocusing voltages to prevent the electrons that comprise the beams from leaving beam guide-isolator 70.

The side plates 62 shown by FIG. 8, further define the beam channel. The potential on side plates 62 is preferably fixed to supply a constant force to electron beam 76, in contrast to the repetitive and substantially periodically varying force applied by ladder electrodes 100 and conductive strips 96. In essence, the walls of beam guide isolator 70 are devised to direct the electrons comprising the beam away from the walls and through the central region of the beam channel.

The progression of the beam through beam guide-isolator 70 perpendicular to the edge of the panel and parallel to faceplate 60 continues to the desired point of diversion of electron beam 76 from beam guide isolator 70. The point of diversion shown by FIG. 9 is opposite conductive strip 96y to which has been applied a potential of, for example, minus ten volts. This beam diverting voltage sharply diverts electron beam 76, causing it to emerge from ladder aperture 98y. The beam so diverted towards faceplate 60 enters high gradient field area 102 where it is accelerated to a high energy to activate phosphor target 74.

The partitioning of the preferred embodiment of this structure into two distinct sections is again clearly shown by FIG. 9, wherein the panel structure comprises a high-voltage front section 66 and a low-voltage rear section 68. The electron transmissive screen 104, which is disposed between beam guide-isolator 70 and faceplate 60, performs the functions specified in the foregoing.

Figure 10:
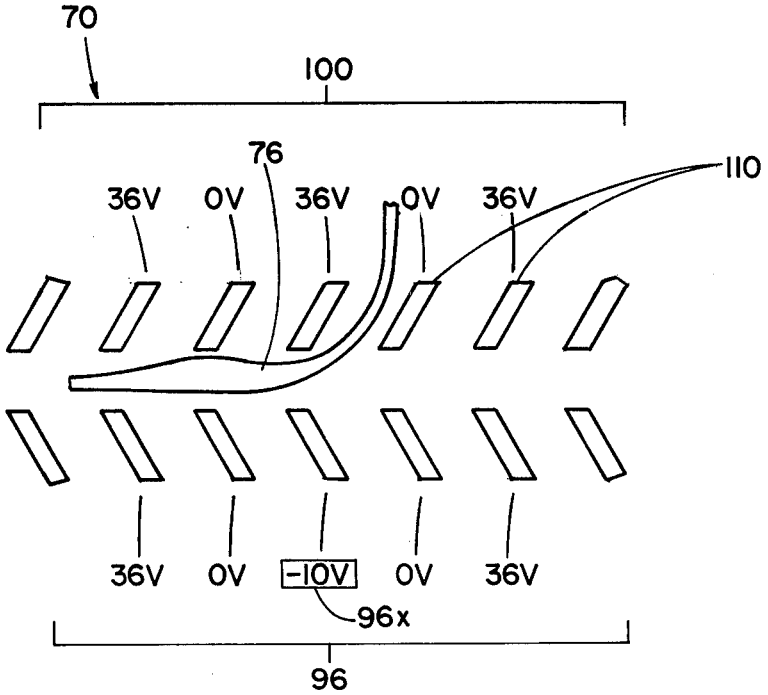
FIG. 10 is a computer plot showing the path of an electron beam as diverted from a beam guide-isolator according to this invention wherein electrodes are angled forwardly and outwardly.

The fingers of ladder electrode 100, and conductive strips 96, are shown by FIG. 9 as being aligned orthogonally to the line of travel of electron beam 76. An alternative embodiment of the beam-diverting structure is shown by FIG. 10, wherein the electrodes 110 comprising the ladder electrode and conductive strips are angled outwardly and forwardly relative to the line of beam travel to facilitate diversion of the beam from beam guide-isolator 70 and to provide isolation of the propagated beam 76 from the forces of the high gradient field 102. The diversion of electron beam 76 from beam guide isolator 70 is shown as being accomplished by a change of potential of electrode 96x to a value of, for example, minus ten volts.

Figure 11:
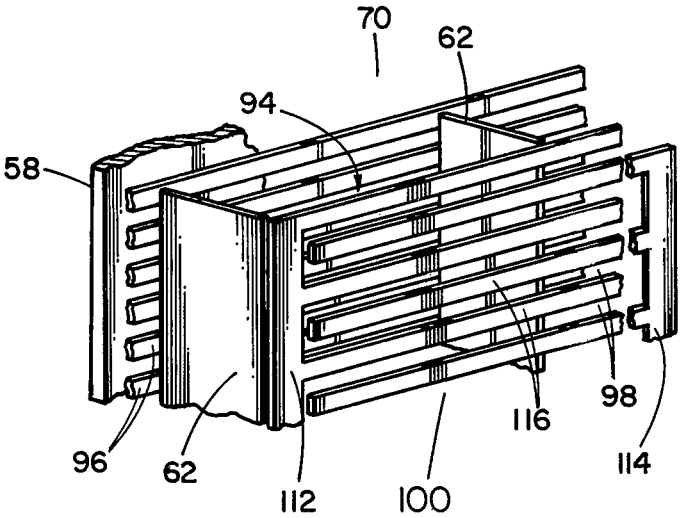
FIG. 11 is a fragmentary perspective view showing components of a beam guide-isolator constructed in accordance with the principles of this invention.

In the foregoing, the structure of beam guide-isolator 70 has been shown in simplified form to facilitate understanding of the preferred embodiment of the invention. FIG. 11 shows the structure that represents the preferred embodiment of beam guide-isolator 70 in greater detail. As noted, a plural number of beam guide-isolators 70 extend column-wise across the full width of the panel to provide channels for a plural number of electron beams, one for each beam. These beam guide-isolators extend to the full height of display panel 56 to provide access of the plurality of electron beams to the entire imaging area of the panel 56.

The beam channel 94 of beam guide-isolator 70 shown in the preferred embodiment by FIG. 11 comprises two spaced, facing ladder-like electrodes, the front one, nearest the faceplate, being ladder electrode 100. A second ladder-like electrode comprises a series of discrete row-wise conductive strips 96 located nearest back wall 58. Ladder electrode 100 comprises two electrically discrete comb-like members 112 and 114, the fingers 116 of which are interdigitated with apertures therebetween and which extend row-wise across the entire width of the panel.

Each of the discrete, row-wise conductive strips 96 is shown as lying parallel with and opposed to one of fingers 116. Each of the comb-like members 112 and 114 preferably has a different potential thereon, and each of the discrete conductive strips 96 opposed to one of said fingers generally may have similar potentials thereon. Beam channel 94 may be further enclosed by the two electrically discrete conductive side plates 62 to define the channel for guiding the electron beam 76.

The side plates 62 are preferably operated at a relatively low potential, for example, plus five volts, which is generally below the average value applied to the fingers 116 of ladder electrode 100. This potential serves to repel the beam from the immediate vicinity of side plates 62, thus constricting the beam inwardly from the sides and causing it to be propagated through the central region of beam guide-isolator 70.

Each strip-and-finger combination also may preferably have an identical potential thereon so that the different potentials along beam guide isolator 70 may impose upon the electron beam a repetitive and preferably a substantially periodic succession of focusing and refocusing voltages applied by each strip-and-finger combination to constrain the electrons comprising the beam from leaving beam guide-isolator 70. Electron beam 76 is shown in FIG. 9 as being diverted from beam guide-isolator 70 by altering the potential on a selected one of the conductive strips 96 to cause beam 76 to be sharply diverted from beam guide-isolator 70 through one of a plurality of ladder apertures 98 toward faceplate 60 and associated anode 72.

As described in the foregoing, and as illustrated by FIG. 9, the potentials on opposed ones of accelerating grids 90, decelerating grids 92 and each strip-and-finger combination are shown as being identical for exemplary purposes. This allotment of potentials is not so limited, and it is within the scope of this invention to provide for the directing, shaping and propagation of electron beams by means of other values and the sequence of theiir application. For example, the electrodes having similar functions may be electrically correlated, as shown by FIG. 9, or in staggered paired potential as shown by FIG. 9A.

Neither is the configuration of the structure as shown and described of necessity for the functioning of the invention, as structural parts and their relationships can also be varied. For example, repetitive and substantially periodic focusing and refocusing fields are illustrated in FIG. 9 as being applied to electron beam 76 by the ladder electrodes 100 and conductive strips 96. The side plates 62 illustrated in FIG. 4 could as well be ladder-like according to this invention and similarly impose a repetitive, but substantially periodic focusing and refocusing field upon beam 76. Also, it is entirely feasible that only one wall of the four walls that comprise beam guide-isolator 70 be devised so as to apply such focusing and refocusing fields to the beam; the other three walls could as well have a constant potential thereon. Neither is it necessary, as shown by FIG. 9B, that the conductive strip electrodes 96A be identical in size and shape to the opposed electrodes 100A of ladder electrode 100.

Figure 12:
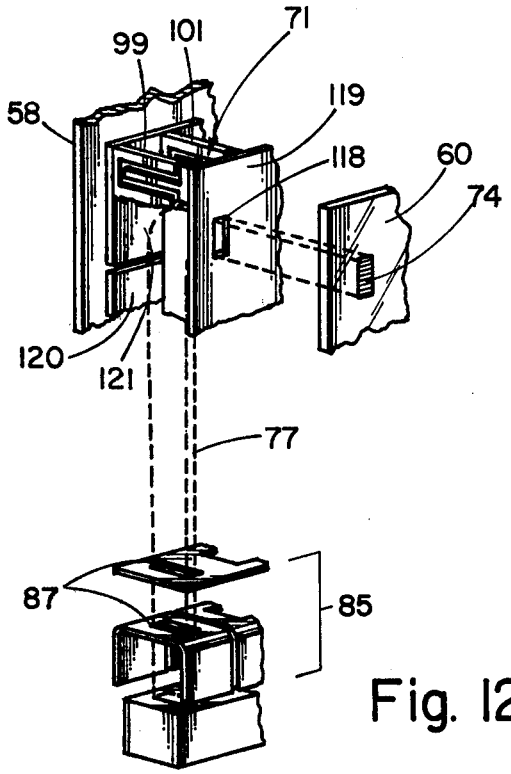
FIG. 12 is a fragmentary perspective view showing an electron beam diverted through an aperture in the side plate of a beam guide-isolator.

Another embodiment of the invention is shown by FIG. 12 wherein the entire beam guide-isolator is reoriented in effect by rotating the beam guide-isolator ninety degrees. It will be seen that one of the aforedescribed side plates 62 now faces faceplate 60, while the opposite side plate now lies in the place of one of the aforedescribed conductive strips 96. In this embodiment, the electron beam 77 emerges through (the now) front plate 119 through aperture 118. Two ladder electrodes 99 and 101 are now in the former place of the end plates, and provide the same function of repetitively and preferably periodically focusing and refocusing electron beam 77 to constrain the electrons comprising beam 77 from leaving beam guide-isolator 71. In this alternative embodiment, each backplate 120 and 121 extends row-wise and takes over the function of one row of the discrete row-wise conductive strips 96, and is similarly located contiguous to back wall 58. A change in the potential on backplate 121 from a nominal plus five volts to minus five volts, for example, causes the diversion of beam 77 from beam guide-isolator 71 through aperture 118 from the selected precise position opposite faceplate 60 to activate phosphor target 74. Since the backplates are row-wise extending, a change in potential of a backplate will result in a deflection of all beams on the level of the backplate.

In this embodiment, the several grids 85 must be modified to reflect the ninety-degree re-orientation of beam guide-isolator 71, as will be noted in the illustration. For example, slots 87 in grids 85 are shown as being rotated in orientation ninety degrees.

As noted in the foregoing, the electron beam cathodoluminescent panel display that is the subject of this disclosure is particularly suitable for the display of television pictures. It is also useful for other image displays such as alphanumeric, computer and computer graphics. The following description is concerned primarily with the display of color television pictures.

Figure 13:
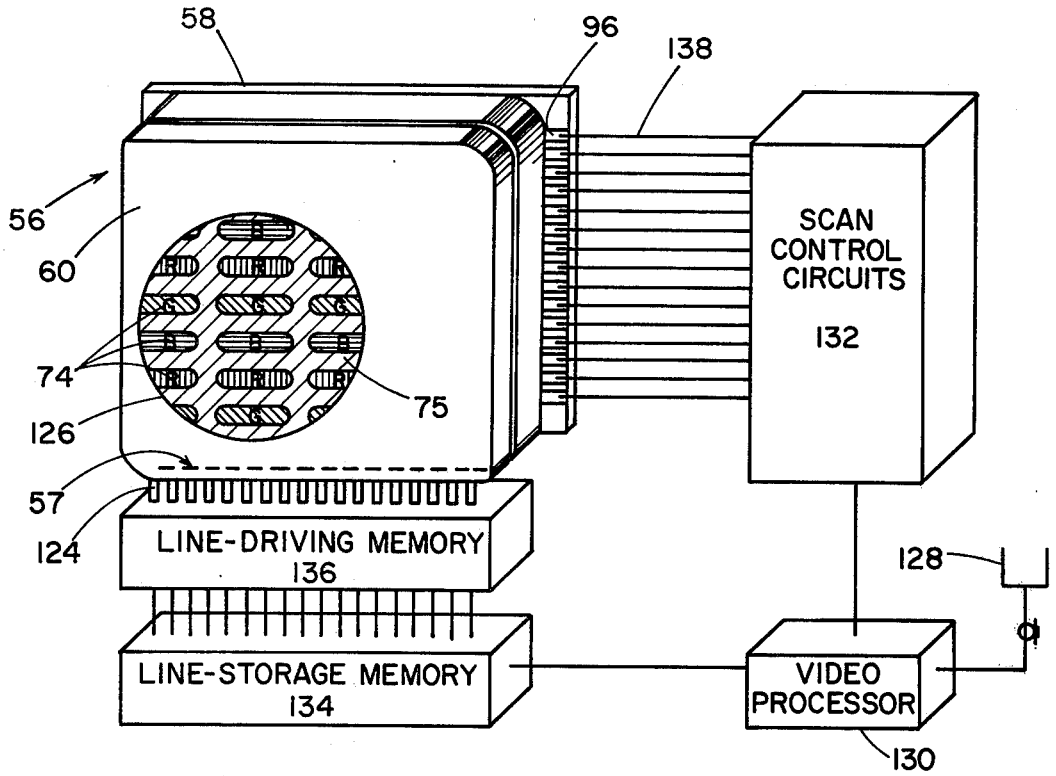
FIG. 13 shows in highly schematic form a television panel display according to this invention utilizing ancillary video processing and scanning components.

The ancillary components and connections required for the adaptation of panel display 56 to the requirements of color picture reproduction are shown in highly schematic form in FIG. 13. Display panel 56 comprises the structure of the preferred embodiment of the invention described in the foregoing. The major components involved in television picture reproduction according to this invention are shown; namely, a faceplate 60, a back wall 58, conductive strips 96, and conductors 124 that lead to modulation grids 88. Grids 88 (not shown) are represented as being disposed along a line 57 of panel 56 behind faceplate 60. Section 126 on faceplate 60 represents an enlargement of a small area of faceplate 60 showing in detail the cathodoluminescent phosphor targets 74 which comprise rows of alternating red, green and blue picture elements arranged in rows and columns as shown. It will be recalled that there is one discrete conductive strip 96 for control of one discrete row of phosphor targets 74, and one discrete modulation grid 88 for control of each discrete column of phosphor targets 74 vertically propagated through beam guide-isolators 70 (not shown).

To enhance color purity, contrast, and to reduce front reflection, the phosphor targets 74 may be surrounded with a light-absorptive material 75 as is well-known to the art.

Ancillary circuits required for processing of the color television signal, and scanning and modulation of the electron beams that activate phosphor targets 74 to provide a modulated raster scan, may include video processor 130, scan control circuits 132, line storage memory 134, and line driving memory 136. The four ancillary circuits 130–136 may be constructed according to principles well-known to those skilled in the art.

In operation, antenna 128 receives an over-the-air television picture broadcast signal. This is a composite signal comprising discrete chrominance, luminance, and synchronization signals. The signal is processed in video processor 130, which separates the composite signal into the discrete signals recited supra. The information comprising the red, green and blue signals derived from chrominance and luminance signals is stored line-by-line in line-storage memory 134. This information is then transferred in parallel to the line driving memory 136, and the line-storage memory 134 is erased to accept the next line's worth of information from video processor 130. While the next line of information is being stored, driving memory 136 provides color information signals through conductors 134 to drive the discrete modulation grids 88 located within the panel along line 57. One grid is provided for modulating each column of electron beams as described in the foregoing. These modulating signals provide for the control of the hue, chroma and intensity of each line of phosphor targets 74 displayed on panel 56.

Video processor 130 also provides synchronization signals derived from the composite signal to the scan control circuits 132. Conductors 138 electrically link the output of the scan control circuits 132 to the plurality of row-wise extending conductive strips 96. In response to synchronizing signals received from video processor 130, scan control circuits 132 selectively and sequentially change the potential on each of said conductive strips 96 usually in a top-to-bottom direction to provide a sharp, simultaneous diversion of the column-wise extending beams from the beam guide-isolators 70 toward faceplate 60, as heretofore described.

By the means described; that is, the sharp, simultaneous diversion of all of the electron beams upon reaching a selected row, image display panel 56 can be scanned at television scan rates according to NTSC standards. The type of scanning can be the standard interlaced type; that is, scanning one field of even lines from top to bottom, then scanning the other field of odd lines from top to bottom at a scanning rate of sixty fields per second to provide thirty complete frames per second.

Figure 14:
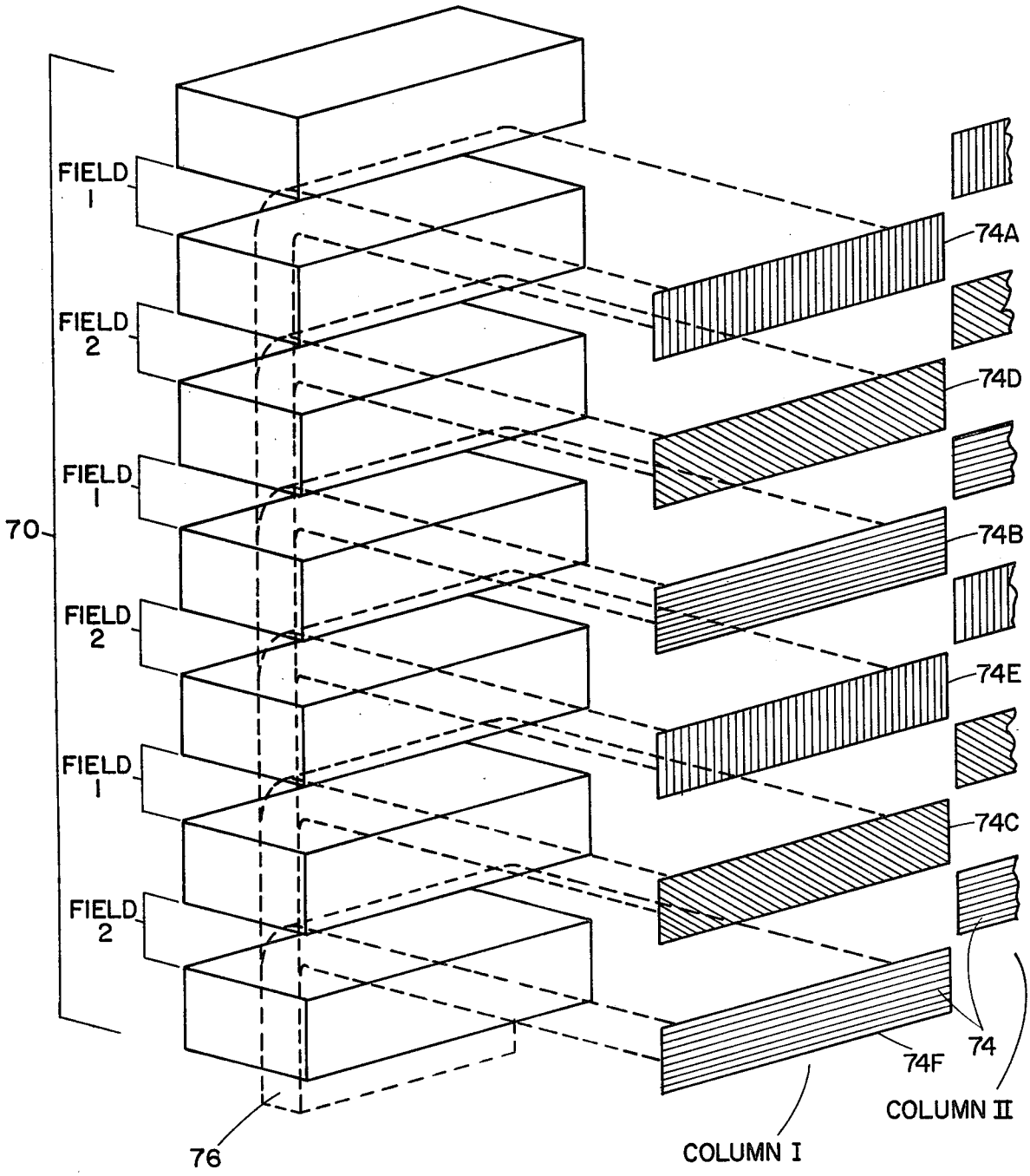
FIG. 14 is a greatly simplified schematic diagram in perspective showing scanning in relation to beam guide-isolators and correlative phosphor targets in accordance with this invention.

A modification of the simple scanning procedure described in the foregoing is required for the proper display of color television pictures. A suitable modification, which represents a preferred embodiment, is provided by the scanning means shown by FIG. 14. The components shown by FIG. 14 are in highly schematic form, but they will be readily recognized as beam guide-isolator 70 and electron beam 76. Phosphor targets 74 are shown in two columns; column I targets are designated 74A–F. The rows of phosphor targets are addressed as described in the following.

During one field of scan, electron beam 76 of column I may issue from a top one of one of a series of bracketed apertures denoted as "field 1" in the illustration, then successively illuminate red phosphor target 74A, blue phosphor target 74B and green phosphor target 74C. Accomplishment of this triple scanning within the time of a single monochrome line requires that each line of targets 74A, 74B and 74C be scanned at a frequency of 3H, or, one-third the normal scanning time for one line, so each line is illuminated for a period of approximately fifteen to twenty microseconds. (1/"H" is the well-known constant equivalent to 63 microseconds.) This scanning sequence continues from top to bottom of the display panel until the entire field 1 has been scanned. Then the field 2 apertures are scanned in sequence in a like manner; e.g., phosphor target 74D, 74E and 74F are illuminated successively at a frequency of 3H until the entire field 2 has been scanned, thus completing the scanning of one entire frame.

As each beam illuminates a phosphor target in its column, it is modulated with suitable chrominance and luminance information supplied by the line-storage memory 134 and line-driving memory 136.

To provide diversity of phosphor pattern, alternate columns of the beam guide-isolators may preferably be offset vertically a distance equal to one and one-half the center-to-center distance between the rows, together with their correlative phosphor targets. This offsetting will be seen by a comparison of the relative horizontal levels of the phosphor targets 74 comprising column I and column II in FIG. 14.

The structure representing the preferred embodiment of this invention as described in the foregoing lends itself equally well to the display of monochrome television images. To provide for a solely monochrome display, the color television picture display system shown by FIG. 13 and described in the foregoing would be modified as follows: Scan control circuit 132 would operate at frequency H rather than 3H and only one-third as many beam ladder electrodes would be needed. The inner surface of faceplate 60 can be covered with a homogeneous coating of monochrome phosphor material. Video processor circuit 130 can be simplified in that it would be necessary to supply only luminance information to line-storage memory 134.

The preferred embodiment of the invention as described lends itself equally well to the display of images other than television such as alphanumeric, computer and computer graphics.

In the preferred embodiment described in the foregoing, a monolithic thermionic cathode is described. The supplying of electrons by thermionic means is a major factor in energy consumption, so there is incentive to search for more energy-efficient sources such as field emission or other efficient means.

With regard to dimensions and the structural relationships of the illustrated preferred embodiment, these factors are in conformance with NTSC standards for the imaging of television pictures. The dimensions of the phosphor targets 74 may be, by way of example, 20 mils high and 60 mils wide, providing a picture element small enough so as not to be distinguishable at normal viewing distance. Further, in conformance with NTSC broadcast standards, the display area of faceplate 60 may encompass about four hundred and fifty lines of tri-color picture elements (1350 color lines) and five hundred columns, each column of which would comprise a discrete beam guide-isolator 70. All dimensions depend, of course, upon ultimate screen size, and the structural components may be scaled down or up accordingly in a manner well-known to those skilled in the art.

With regard to phosphor composition, standard television cathode ray tube phosphors may be used in the preferred embodiment of the invention as disclosed. Continuing research in phosphor technology will eventually result in phosphors which are highly efficient at lower screen voltages; that is, anode voltages in the range of one to five kilovolts. Zinc oxide is a present example of such an efficient low-voltage phosphor. Although the embodiment of the invention disclosed herein will function effectively with phosphors requiring relatively higher voltages; that is, in the range of five to fifteen kilovolts, the availability of more efficient, low-voltage phosphors would be advantageous in view of the lower display panel voltage requirements.

With regard to component construction, well-known techniques such as photo-forming, or shaping and cutting by laser, can be utilized for fabrication of intricate parts such as the ladder electrodes. Tolerances of these electrodes and the other parts comprising the beam guide-isolator must be in the range of a few mils, departures of the surface from an ideal plane being particularly undesirable.

It must be recognized that changes may be made in the above-described apparatus without departing from the true spirit and scope of the invention herein involved, and it is intended that the subject matter in the above depiction shall be interpreted as illustrative and not in a limiting sense.

I claim:

1. An image display panel comprising an evacuated, self-supporting envelope having a back wall and having an anode and faceplate with a pattern of cathodoluminescent phosphor targets deposited on an inner surface thereof, said panel being partitioned into two distinct sections comprising:

a high-voltage front section comprising said anode and said faceplate for receiving a relatively high voltage; that is, a voltage in the kilovolts range; and a low-voltage rear section located contiguous to said back wall and electrically isolated from said faceplate by electron-transmissive mesh means, said low-voltage section comprising:

electron source means disposed along a row-wise edge of said panel for emitting a supply of electrons;

sequential beam-shaping and -modulating grid means adjacent to said electron source means for directing said electrons into a side-by-side, column-wise series of vertically propagating electron beams and for modulating said beams, said means comprising accelerating means comprising at least one grid for accelerating in a straight-line path said electrons in each of said beams to draw from said source means a desired electron density; decelerating means comprising at least one grid for decelerating along said straight-line path said electrons comprising said beams for reducing their energy to cause said beams to be responsive to relatively low beam-control voltages; and modulating grid means for modulating said beams with discrete time-varying signals;

beam guide-isolator means for each of said beams adjacent to but apart from said electron source means and grid means for directing said electrons in the form of relatively low-energy electron beams, that is, beams having an energy of not more than a few hundred electron volts, said beam guide-isolator means directing the beams perpendicularly to said edge and parallel to said faceplate, and isolating said beams from an attractive high-gradient field of said anode;

electron-transmission screen means disposed between said beam guide-isolator and said anode for further isolating said beam within said beam guide-isolator from an attractive high-gradient field of said anode, and for providing an initial, mild acceleration to said beam; and beam-diverting means responsive to the application of relatively low applied beam-diverting voltages for sharply diverting said beams from a selected precise position opposite said faceplate, said beams being diverted from an aperture in said beam guide-isolator toward said faceplate and into a field of said anode whereupon the electrons in said beams are accelerated to a high energy to brightly activate said phosphor targets.

2. An image display panel comprising an evacuated, self-supporting envelope having a back wall and having an anode and faceplate with a pattern of cathodoluminescent phosphor targets deposited on an inner surface thereof, said panel being partitioned into two distinct sections comprising:

a high-voltage front section comprising said anode and said faceplate for receiving a voltage in the kilovolts range; that is, a voltage in the range of eight hundred volts to ten thousand volts; and a low-voltage rear section located contiguous to said back wall and comprising:

electron source means disposed along a row-wise edge of said panel for emitting a supply of electrons;

at least one beam guide-isolator responsive to relatively low applied beam control voltages for directing in a straight-line path electrons emitted by said electron source means in a relatively low-energy electron beam; that is, a beam having an energy of no more than a few hundreds of electron volts and for further directing said beam along said straight-line path through said beam guide-isolator perpendicular to said edge and parallel to said faceplate;

electron-transmissive screen means disposed between said beam guide-isolator and said anode for further isolating said beam within said beam guide-isolator from an attractive, high-gradient field of said anode, and for providing an initial, mild acceleration to said beam, said screen means having thereon a potential of no more than a few hundred volts; and beam-diverting means responsive to the application of relatively low applied beam-diverting voltages for sharply diverting said beam from a selected precise position opposite said faceplate, said beam being diverted from an aperture in said beam guide-isolator toward said faceplate and into a field of said anode, whereupon the electrons in said beam are accelerated to a high energy to brightly activate said phosphor targets, said relatively low beam-diverting voltages being in the range of a few tens of volts.

3. An image display panel comprising an evacuated self-supporting envelope having a back wall and having an anode and faceplate with a pattern of cathodoluminescent phosphor targets deposited on an inner surface thereof, said panel being partitioned into two distinct sections comprising:

a high-voltage front section comprising said anode and said faceplate for receiving a relatively high voltage; that is, a voltage in the kilovolts range; and a low-voltage rear section located contiguous to said back wall and partitioned from said faceplate and said anode, and electrically isolated from said anode by electron-transmissive mesh means, said rear section including beam guide-isolator means; and, an electron source means disposed along a row-wise edge of said panel for emitting a supply of electrons wherein at least one electron beam is formed from electrons emitted by said source means for guidance and isolation by said beam guide-isolator means, said beam first being accelerated in a straight-line path by accelerating means comprising at least one grid means having a relatively high potential thereon for drawing from said source means a desired electron density, then secondly, said beam being decelerated along said straight-line path by successive decelerating means comprising at least one grid means having a relatively lower potential thereon for reducing the energy of said beam and making it responsive to relatively low beam-directing modulating and diverting voltages, said electron source means and said grid means being adjacent to but apart from said beam guide-isolator means.

4. Sequential grid means for directing, shaping and modulating at least one low-energy electron beam for use in an image display panel, said panel comprising an evacuated, self-supporting envelope having a back wall and having an anode and faceplate with a pattern of cathodoluminescent phosphor targets deposited on an inner surface thereof, said panel being partitioned into two distinct sections comprising a high-voltage front section comprising said anode and said faceplate for receiving a relatively high voltage; that is, a voltage in the range of kilovolts, and a low-voltage rear section located contiguous to said back wall and having an electron source means disposed along a row-wise edge of said panel for emitting a supply of electrons with said grid means located adjacent to said electron source means, said rear section including beam guide-isolator means for said beam adjacent to but apart from said electron source means and grid means, said grid means having beam-passing apertures therethrough and comprising in the following sequence:

beam-segregating and -collimating means for directing and shaping electrons from said electron source means into a vertically propagating beam;

modulating grid means for modulating said beam with a time-varying signal;

a plurality of sequential accelerating and decelerating means comprising sequential grid means having predetermined potentials thereon, said means affecting said beam in its passage through said apertures as follows:

said accelerating means comprising at least one grid means having thereon a relatively higher potential for drawing from said source means a desired electron density, and accelerating in a straight-line path said electrons;

said decelerating means comprising at least one grid means having thereon a relatively lower potential for decelerating along said straight-line path said electrons and reducing their energy, said grid means being interspersed with at least one baffle means having a beam-passing aperture smaller than said apertures in said grid means to intercept aberrant electrons; that is, electrons traveling in a path outside a main path of said beams.

5. Row-scanning means for an image display panel, said panel comprising an evacuated, self-supporting envelope having a back wall and having an anode and faceplate with a pattern of rows of cathodoluminescent phosphor targets deposited on an inner surface thereof, said panel being partitioned into two distinct sections comprising a high-voltage front section comprising said anode and said faceplate for receiving a relatively high voltage; that is, a voltage in the range of kilovolts, and a low-voltage rear section located contiguous to said back wall and having an electron source means disposed along a row-wise edge of said panel for emitting a supply of electrons, said electrons being directed into a side-by-side, column-wise series of vertically propagated low-energy electron beams conducted by discrete beam guide-isolators located perpendicular to said edge and parallel to said faceplate, said beam guide-isolators each comprising two spaced, facing electrically discrete ladder-like electrodes having two electrically discrete conductive side plates to form a channel for guiding said beams, with a front one of said electrodes; that is, one nearest said faceplate, comprising two electrically discrete comb-like members having interdigitated fingers with apertures therebetween, and with a rear one of said electrodes; that is, the one nearest said back wall, comprised of electrically discrete, row-wise conductive strips, each strip lying parallel with an opposed to one of said fingers, with each alternating strip-and-finger combination having predetermined potentials thereon for the repetitive and substantially periodic focusing and refocusing of said beams, wherein said row-scanning means provides a sharp, simultaneous diversion of all of said beams from said beam guide isolators through ones of said apertures toward said faceplate from a selected, precise horizontal position opposite one of said discrete, row-wise conductive strips by means of a change in potential on said strip, whereupon the electrons of said beams are accelerated to a high energy by an attractive field of said anode to brightly activate at least one of said rows of said phosphor targets.

6. The image display panel defined by claim 5 wherein said fingers and said strips of said ladder electrodes are angled forwardly and outwardly relative to the line of travel of said beam to facilitate diversion of said beam from said beam guide-isolator, and to provide isolation of said beam from a nearby attractive high gradient field of said anode.

7. The scanning means defined by claim 5 wherein alternating ones of said beam guide-isolators are offset vertically a distance equal to one-and-one-half the center-to-center distance between said rows, and wherein correlative ones of said phosphor targets are similarly offset to provide diversity in said pattern of phosphor targets.

8. An image display panel comprising an evacuated, self-supporting envelope having a back wall and having an anode and faceplate with a pattern of cathodoluminescent phosphor targets deposited on an inner surface thereof, said panel being partitioned into two distinct sections comprising:

a high-voltage front section comprising said faceplate and said anode for receiving a relatively high voltage; that is, a voltage in the kilovolts range; and a low-voltage rear section located contiguous to said back wall and comprising:

electron source means disposed along a row-wise edge of said panel for generating a supply of electrons;

at least one beam guide-isolator responsive to relatively low applied beam control voltages for directing electrons emitted by said electron source means into a relatively low energy electron beam; that is, a beam having an energy of not more than a few hundred electron volts, and for further directing the beam perpendicular to said edge and parallel to said faceplate, and for isolating said beam from an attractive high gradient field of said anode, said beam guide-isolator comprising two spaced, facing, electrically discrete ladder-like electrodes having two electrically discrete conductive side plates to define a channel for guiding said beam, with a front one of said electrodes; that is, the one nearest said faceplate comprising two electrically discrete comb-like members, the fingers of which are interdigitated, with apertures therebetween, and with the rear one of said electrodes; that is, the one nearest said back wall, being comprised of discrete, row-wise conductive strips, each strip lying parallel with and opposed to one of said fingers, each strip-and-finger combination having a predetermined potential thereon to impose upon said beam a repetitive and substantially periodic succession of focusing and refocusing voltages applied by said opposed strips and fingers to constrain the electrons comprising said beam from leaving said beam guide-isolator; and beam-diverting means responsive to the application of relatively low applied beam diverting voltages for sharply diverting said beam from a selected precise position opposite said faceplate, said beam being diverted from an aperture in said beam guide-isolator toward said faceplate and into said anode field whereupon the electrons in said beam are accelerated to a high energy to brightly activate at least one of said phosphor targets.

9. An image display panel comprising an evacuated, self-supporting envelope having a back wall and having an anode and faceplate with a pattern of cathodoluminescent phosphor targets deposited on an inner surface thereof, said panel being partitioned into two distinct sections comprising:

a high-voltage front section comprising said faceplate and said anode for receiving a relatively high voltage; that is, a voltage in the kilovolts range; and a low-voltage rear section located contiguous to said back wall comprising:

electron source means disposed along a row-wise edge of said panel for generating a supply of electrons;

at least one beam guide-isolator responsive to relatively low applied beam control voltages for directing electrons emitted by said electron source means into a relatively low-energy electron beam; that is, a beam having an energy of not more than a few hundred electron volts, and for further directing the beam perpendicular to said edge and parallel to said faceplate, and for isolating said beam from an attractive high gradient field of said anode, said beam guide-isolator comprising two spaced, facing, electrically discrete ladder-like electrodes having two electrically discrete conductive side plates to define a channel for guiding said beam, with a front one of said electrodes; that is, the one nearest said faceplate comprising two electrically discrete comb-like members, the fingers of which are interdigitated, with apertures therebetween, and with the rear one of said electrodes; that is, the one nearest said back wall, being comprised of discrete, row-wise conductive strips, each strip lying parallel with and opposed to one of said fingers, each strip-and-finger combination having a predetermined potential thereon to impose upon said beam a repetitive and substantially periodic succession of focusing and refocusing voltages applied by said opposed strips and fingers to constrain the electrons comprising said beam from leaving said beam guide-isolator; and beam-diverting means responsive to the application of relatively low applied beam-diverting voltages for sharply diverting said beam from a selected precise position opposite said faceplate, said beam-diverting means including means for altering the potential on a selected one of said conductive strips to cause said beam to be sharply diverted from said beam guide-isolator through one of said apertures toward said faceplate and into said anode field whereupon the electrons in said beam are accelerated to a high energy to brightly activate at least one of said phosphor targets.

* * * * *